US009889868B2

(12) United States Patent
Kim et al.

(10) Patent No.: US 9,889,868 B2
(45) Date of Patent: Feb. 13, 2018

(54) DEDICATED CHANNEL ESTABLISHMENT METHOD AND APPARATUS FOR HIGH SPEED DATA TRANSMISSION IN RAILWAY WIRELESS SENSOR NETWORK

(71) Applicant: Electronics and Telecommunications Research Institute, Daejeon-si (KR)

(72) Inventors: Young Il Kim, Daejeon (KR); Geon Min Yeo, Daejeon (KR); Jae Hoon Kim, Goyang-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 307 days.

(21) Appl. No.: 14/246,184

(22) Filed: Apr. 7, 2014

(65) Prior Publication Data

US 2014/0336850 A1 Nov. 13, 2014

(30) Foreign Application Priority Data

May 9, 2013 (KR) ..... 10-2013-0052780

(51) Int. Cl.
*B61L 27/00* (2006.01)
*B61L 15/00* (2006.01)

(52) U.S. Cl.
CPC ..... *B61L 27/0005* (2013.01); *B61L 15/0027* (2013.01)

(58) Field of Classification Search
CPC ..... B61L 27/0005
See application file for complete search history.

(56) References Cited

U.S. PATENT DOCUMENTS

| | | | | |
|---|---|---|---|---|
| 6,680,946 | B1 * | 1/2004 | Isoyama et al. | 370/395.61 |
| 2006/0015566 | A1 * | 1/2006 | Sampson | 709/206 |
| 2009/0147768 | A1 * | 6/2009 | Ji | H04J 3/0664 370/350 |
| 2011/0282540 | A1 * | 11/2011 | Armitage et al. | 701/29 |
| 2012/0126850 | A1 * | 5/2012 | Wasson et al. | 326/38 |
| 2012/0317436 | A1 * | 12/2012 | Elko et al. | 714/1 |
| 2013/0007858 | A1 * | 1/2013 | Shah | H04L 63/0815 726/6 |
| 2013/0170348 | A1 * | 7/2013 | Luna et al. | 370/230.1 |
| 2013/0201316 | A1 * | 8/2013 | Binder et al. | 348/77 |

FOREIGN PATENT DOCUMENTS

| | | | |
|---|---|---|---|
| KR | 10-0839858 | B1 | 6/2008 |
| KR | 10-2010-0067999 | A | 6/2010 |
| KR | 10-2011-0134268 | A | 12/2011 |
| KR | 10-2012-0134720 | A | 12/2012 |

* cited by examiner

*Primary Examiner* — Yonel Beaulieu
*Assistant Examiner* — Martin A Weeks
(74) *Attorney, Agent, or Firm* — NSIP Law

(57) ABSTRACT

Disclosed is a railway wireless sensor network system. The railway wireless sensor network system includes a plurality of sensors which are included in a railway vehicle and measure an operation state of the railway vehicle in real time, a plurality of routers which receive information on the measured operation state through a dedicated channel with each sensor, and a gateway which receives information on the operation state through a dedicated channel between the routers, and periodically transmits information on the received operation state to a railway vehicle control center.

17 Claims, 7 Drawing Sheets

DEDICATED CHANNEL ESTABLISHMENT METHOD AND APPARATUS FOR HIGH SPEED DATA TRANSMISSION IN RAILWAY WIRELESS SENSOR NETWORK

Priority to Korean patent application number 2013-0052780 filed on May 9, 2013, the entire disclosure of which is incorporated by reference herein, is claimed.

BACKGROUND OF THE INVENTION

Field of the Invention

The present invention relates to a method of allocating a wireless channel between a wireless sensor and a router and a wireless channel between routers to enhance transmission efficiency of measuring information and a method thereof in a safety management technology of railway facilities where heat generation state of a bogie and operation state of parts included in a railway vehicle under operation are measured in real time for safety of the railway vehicle.

Discussion of the Related Art

Heating generation state and vibration state of axles of a railway vehicle need to be measured in real time in order to promptly repair the vehicle at the time of occurrence of an abnormal state for safety of the railway vehicle.

To this end, for example, Korean Patent Publication No. 10-2010-0067999 (published on Jun. 22, 2010) "automatic railway vehicle examination apparatus" discloses sensing and systematically managing an abnormal operation of the body of a railway vehicle as well as a wheel and a pantograph.

Currently, a scheme of installing a device for measuring generated heat of a railway vehicle in a non-contacting manner at a railroad, and transmitting measured temperature information to a maintenance center, is used. However, this scheme fails to play an appropriate role due to inaccuracy of measurement and limitation in the number of times measured, and thus accidents are not prevented in advance and trains have been derailed, thereby failing to maintain safe driving.

Hence, there is a need of a method for accurately measuring the state of a railway vehicle under operation and transmitting the measured result to a railway vehicle control center in real time.

SUMMARY OF THE INVENTION

An object of the present invention is to provide a method of setting and operating a dedicated channel for high speed transmission of data in a railway wireless sensor network capable of accurately measuring the state of a railway vehicle and transmitting the measured result to a railway vehicle control center in real time.

Another object of the present invention is to provide a method of setting and operating a dedicated channel for high speed transmission of data in a railway wireless sensor network capable of transmitting information on the operation state of a railway vehicle, which is operated in a poor communication environment, at high speed.

In accordance with an aspect of the present invention, a railway wireless sensor network system includes a plurality of sensors which are included in a railway vehicle and measure an operation state of the railway vehicle in real time, a plurality of routers which receive information on the measured operation state through a dedicated channel with each sensor, and a gateway which receives information on the operation state through a dedicated channel between the routers, and periodically transmits information on the received operation state to a railway vehicle control center.

The router may set the dedicated channel with the sensor and the dedicated channel between the routers by utilizing a contention-free period of a medium access control (MAC) frame.

If a token issuing message is received from the gateway, the router may set the dedicated channel with the sensor and the dedicated channel between the routers.

The token issuing message may include a number of the router, numbers of sensors which are connected to the router, and information on a use period of the dedicated channel.

The gateway may set a dedicated channel with a router of a lowest hierarchy through the dedicated channel between the routers.

The gateway may integrate dedicated channels between the plurality of routers to control the integrated dedicated channels.

When setting the dedicated channel between the routers, the router may encapsulate a dedicated channel path between routers of a lower hierarchy of the router, and transmit the encapsulated path in a tunneling scheme.

The gateway may bind a dedicated channel path between routers of a lower hierarchy of the router to the dedicated channel between the routers.

If information on the operation state is not received from the router until a timer is terminated by operating the timer when issuing a token, the gateway may transmit a path canceling message to the router so as to cancel the dedicated channel with the router.

If the token issuing message is received from the gateway, the router may operate a timer, and if information on the operation state is not received until the timer is terminated, the router may cancel the dedicated channel between sensors, which are connected to the router, based on a token returning message which has been received from the gateway.

Information on the operation state may be information on temperatures and vibrations of bearings which are positioned at axles of the railway vehicle.

In accordance with another aspect of the present invention, a method of operating a gateway in a railway wireless sensor network includes transmitting a token issuing message to a router, receiving information on an operation state of a railway vehicle, which is measured in real time by a sensor included in the railway vehicle, from the router, through a dedicated channel which is set according to the token issuing message, and transmitting the received information on the operation state, periodically, to a railway vehicle control center.

In accordance with yet another aspect of the present invention, a method of operating a router in a railway wireless sensor network includes receiving a token issuing message from a gateway, setting a dedicated channel with a sensor included in a railway vehicle and a dedicated channel with routers according to the token issuing message, receiving information on an operation state of the railway vehicle, which is measured by the sensor, from the sensor, through the dedicated channel with the sensor, and transmitting information on the received operation state to a gateway through the dedicated channel between the routers.

DETAILED DESCRIPTION OF THE EMBODIMENTS

Figure 1:
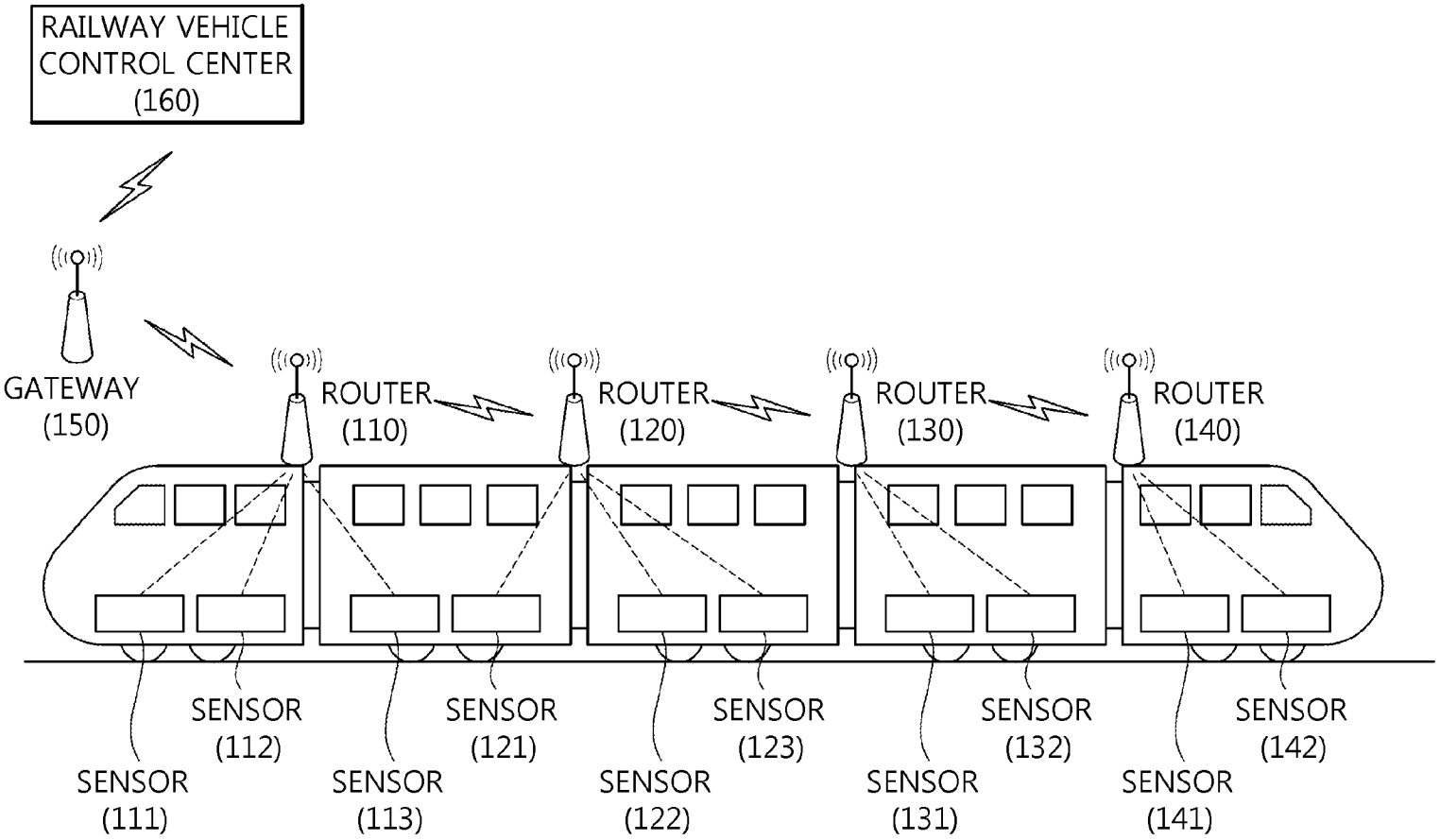
FIG. 1 is a diagram illustrating a railway wireless sensor network system, according to an embodiment of the present invention.

Hereinafter, embodiments of the present invention will be described in detail with reference to the accompanying drawings so that they can be readily implemented by those skilled in the art.

Hereinafter, some embodiments of the present invention are described in detail with reference to the accompanying drawings in order for a person having ordinary skill in the art to which the present invention pertains to be able to readily implement the invention. It is to be noted the present invention may be implemented in various ways and is not limited to the following embodiments. Furthermore, in the drawings, parts not related to the present invention are omitted in order to clarify the present invention and the same or similar reference numerals are used to denote the same or similar elements.

Terms such as "including," "having," "consist of" may be intended to indicate a plurality of components unless the terms are used with the term "only". Terms such as "unit" refer to a unit for processing at least one function or operation, and may be implemented as hardware, software, or a combination of hardware and software.

FIG. 1 is a diagram illustrating a railway wireless sensor network system, according to an embodiment of the present invention.

Referring to FIG. 1, the railway wireless sensor network system according to the present invention may include a plurality of sensors 111, 112, 113, 121, 122, 123, 131, 132, 141, and 142, a plurality of routers 110, 120, 130, and 140, and at least one gateway 150.

Respective sensors 111, 112, 113, 121, 122, 123, 131, 132, 141, and 142 are included in a railway vehicle, and may be connected to routers 110, 120, 130, and 140 having good electric wave receiving intensity. Referring to FIG. 1, for example, a first sensor 111, a second sensor 112, and a third sensor 113 are connected to a first router 110, a fourth sensor 121, a fifth sensor 122, and a sixth sensor 123 are connected to a second router 120, a seventh sensor 131 and a eighth sensor 132 are connected to a third router 130, and a ninth sensor 141 and a tenth sensor 142 are connected to a fourth router 140.

The respective sensors 111, 112, 113, 121, 122, 123, 131, 132, 141, and 142 measure the operation status of the railway vehicle and transmit information on the measured operation status to the routers 110, 120, 130, and 140 in real time. For example, the respective sensors 111, 112, 113, 121, 122, 123, 131, 132, 141, and 142 periodically measure the temperature (T) and vibration (V) of the driving unit (e.g., bearings on axles) of the railway vehicle, and measured values to the connected router 110, 120, 130, or 140.

Each router 110, 120, 130, and 140 may transmit information, which is received from respective sensors 111, 112, 113, 121, 122, 123, 131, 132, 141, and 142, to the gateway 150 via the routers which are positioned at another hierarchy.

The gateway 150 may transmit the information, which is received from the routers 110, 120, 130, and 140, to a railway vehicle control center 160 so that the railway vehicle control center 160 may manage safe driving of the railway vehicle based on the sensor measurement value. At this time, various wireless connection technologies (e.g., IEEE802.15.4/Zigbee) may be used in wireless transmission sections between a sensor and a router, between a router and a gateway, and between routers.

Figure 2:
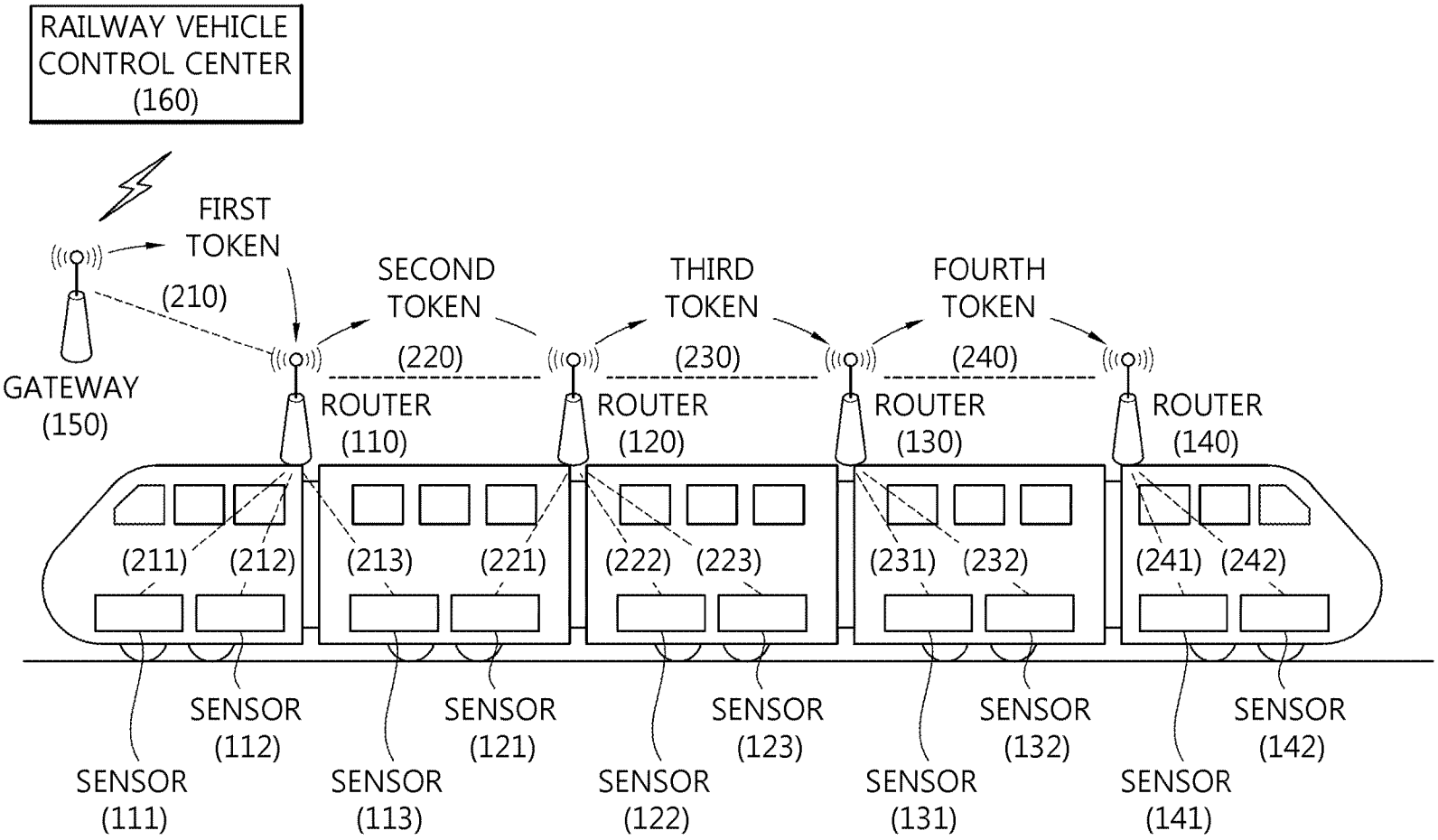
FIG. 2 is a diagram illustrating an operation path of a railway wireless sensor network system according to the present invention.

FIG. 2 is a diagram illustrating an operation path of a railway wireless sensor network system according to the present invention. Hereinafter, referring to FIG. 2, the first sensor 111, the second sensor 112, and the third sensor 113 are connected to the first router 110, the fourth sensor 121, the fifth sensor 122, and the sixth sensor 123 are connected to the second router 120, the seventh sensor 131 and the eighth sensor 132 are connected to the third router 130, and the ninth sensor 141 and the tenth sensor 142 are connected to the fourth router 140.

The gateway 150 issues a token for periodically transmitting measured information to sensors which are connected to a specific router. For example, the gateway 150 may transmit a first token to the first router 110 to receive information (measured values) of the first sensor 111, the second sensor 121, and the third sensor 131. The first router 110, which has received the first token, may form dedicated channels 211, 212, and 213 respectively with the connected sensors, i.e., the first sensor 111, the second sensor 112, and the third sensor 113, and may also set a dedicated channel 210 between the gate 140 and the first router 110 itself. Likewise, the information, which is measured in the sensor through the generated dedicated channel, may be transmitted at high speed without a transmission delay which is generated in the process of accessing a channel.

Further, if a second token is received from the gateway 150, the second router 120 may form dedicated channels 221, 222, and 223 with the sensors 121, 122, and 123 which are connected to the second router 120 itself, and may also set the dedicated channel 220 between the second router 120 itself and the first router 110 and the dedicated channel 210 between the gateway 150 and the first router 110. At this time, when the dedicated channel 210 between the gateway 150 and the first router 110 has been set, the setting is omitted. Likewise, the third router 130 and the fourth router 140 may also set dedicated channels with the connected sensors 131, 132, 141, and 142.

Further, when the gateway 150 does not want dedicated channel type communication with the sensors in a specific router or the wireless channel state is deteriorated, the procedure of returning the token may be performed. For example, when the gateway 150 returns the third token, the setting of the dedicated channel with the sensors 131 and 132, which have been connected to the third router 130, is cancelled, and the dedicated channel 230 between the second router 120 and the third router 130 may also be cancelled. At this time, when the fourth router 140 periodically communicates with the sensors 141 and 142 using a dedicated channel scheme, the dedicated channel 230 between the second router and the third router 130 and the dedicated channel between the third router 120 and the fourth router 130 may be maintained. To this end, the dedicated channels 210, 220, 230, and 240 between routers may be used by tunneling information which is transmitted to respective routers. Hence, the gateway 150 may control sensors, which are connected to some specific routers, among a plurality of routers 110, 120, 130, and 140, independently from other routers.

Figure 3:
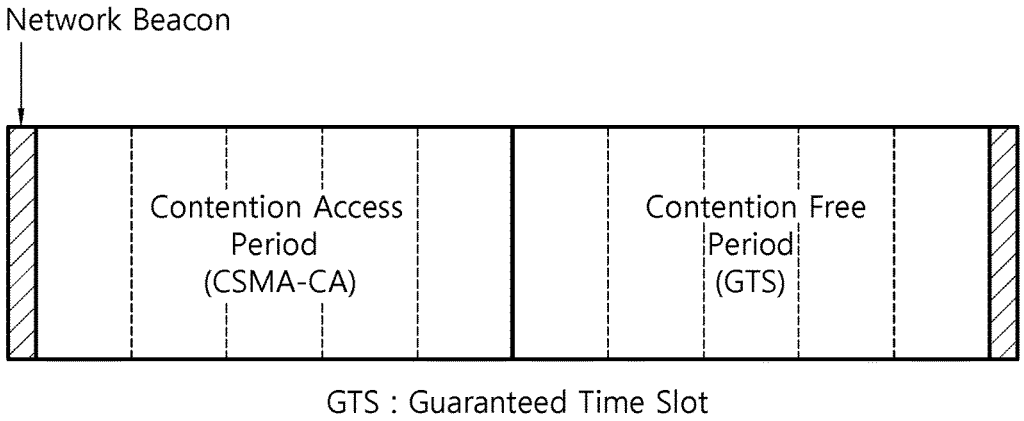
FIG. 3 is a diagram illustrating a structure of a medium access control (MAC) frame of IEEE 802.15.4.

FIG. 3 is a diagram illustrating a structure of a medium access control (MAC) frame of IEEE 802.15.4.

As illustrated in FIG. 3, the MAC frame structure of the low-power wireless sensor network is divided into a carrier sense multiple access-collision avoidance (CSMA-CA) section, which is a contention access period (CAP) for obtaining a channel based on contention for connection of a plurality of terminals, and a guaranteed time slot (GTS) section which is a contention free period (CFP) for obtaining a dedicated channel without contention. In the present invention, in order to transmit information measured in the sensor at high speed, dedicated channels between a sensor and a router, between a router and a gateway, and between routers may be configured by utilizing a GTS section.

Figure 4:
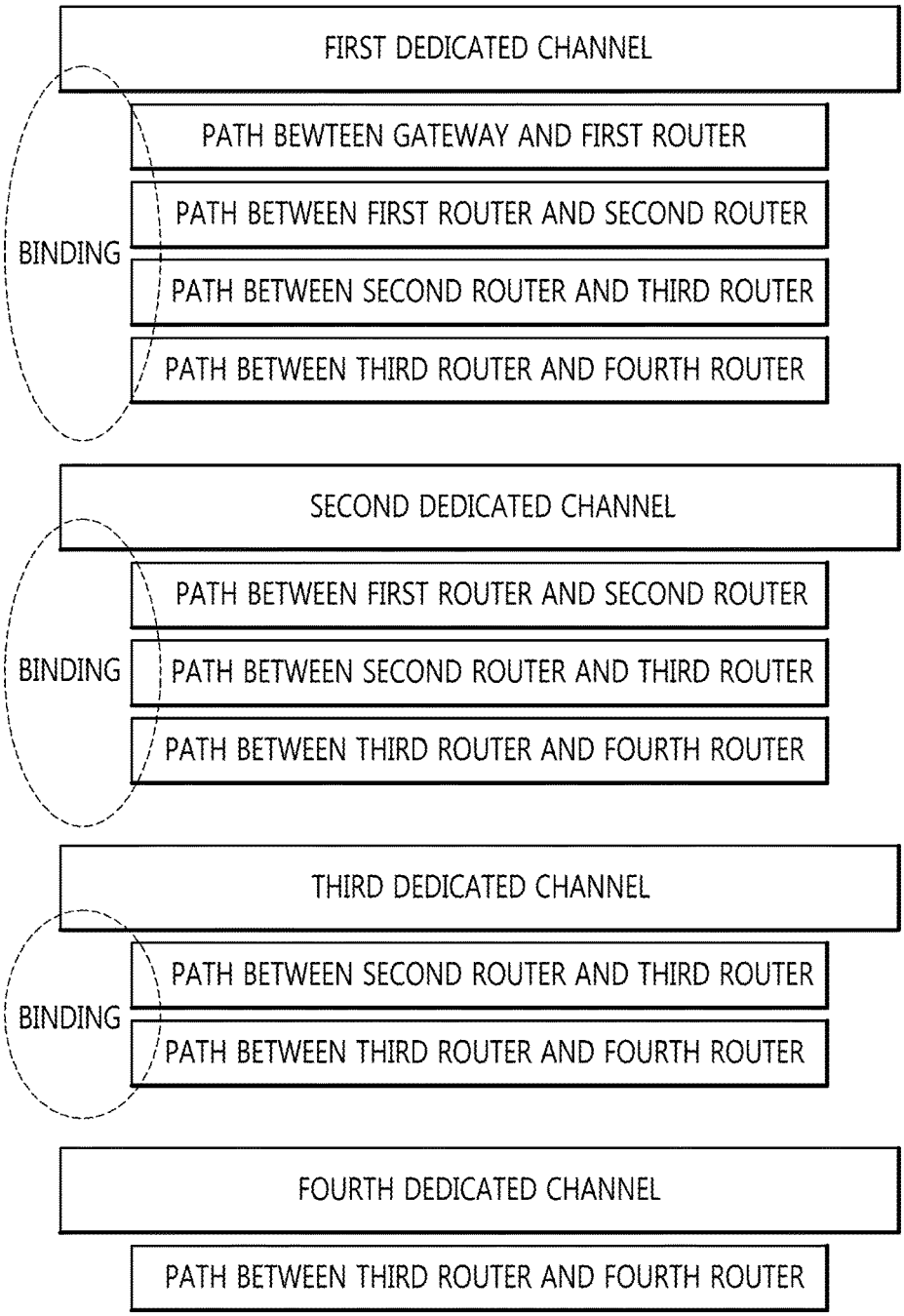
FIG. 4 is a diagram illustrating dedicated channel tunneling between routers, according to an embodiment of the present invention.

FIG. 4 is a diagram illustrating dedicated channel tunneling between routers, according to an embodiment of the present invention.

As illustrated in FIG. 4, respective dedicated channels 210, 220, 230, and 240 may include the path of a lower hierarchy. That is, the first dedicated channel 210 may bind and use paths of dedicated channels 210, 220, 230, and 240 of all hierarchies within the network, and the second dedicated channel 220 may bind and use paths of the dedicated channels 220, 230, and 240 of all hierarchies except the path of the dedicated channel 210 between the gateway 150 and the first router 110. Here, the gateway 150 may randomly access and control the dedicated channel between respective routers.

Figure 5:
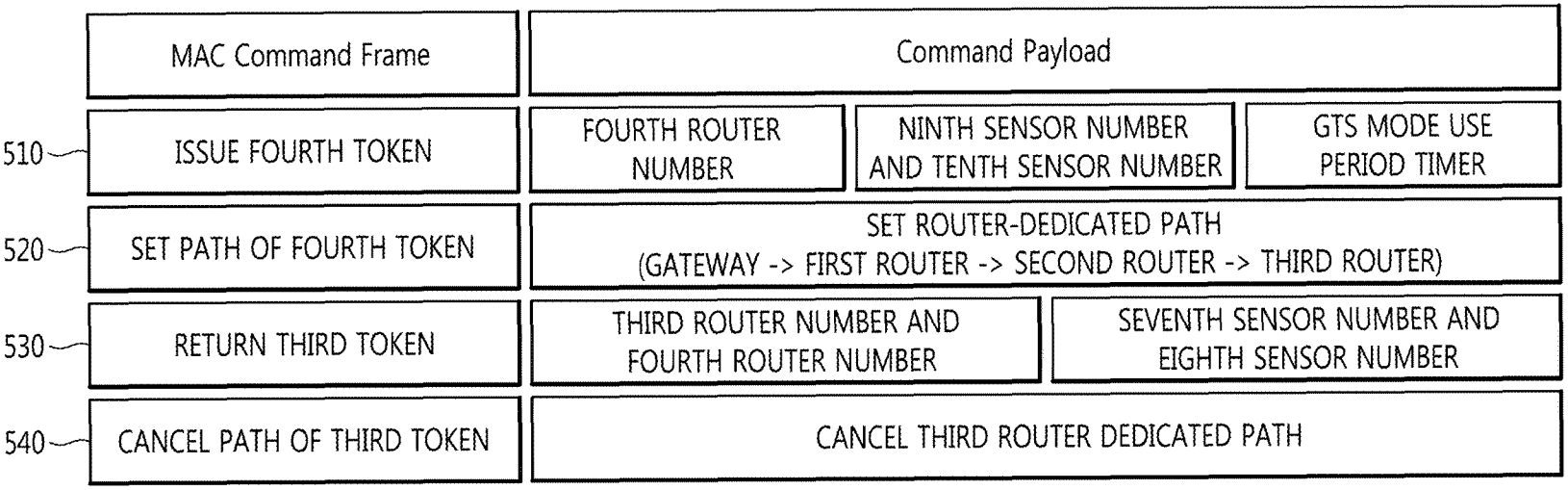
FIG. 5 is a diagram illustrating a dedicated channel path setting MAC message, according to an embodiment of the present invention.

FIG. 5 is a diagram illustrating a dedicated channel path setting MAC message, according to an embodiment of the present invention.

For example, as illustrated in FIG. 5, a token issuing message 510 for issuing a fourth token may use a time for notifying the number (identifier) of the fourth router 140, the number of sensors 141 and 142 related with the fourth router 140, and the period of using the GTS mode, as the payload. If the MAC message is received, the fourth router 140 may set the dedicated channel with the sensors 141 and 142 and set the time value that uses the GTS mode.

Further, a path setting message 520 of the fourth token may include information for setting the dedicated path between routers. If the MAC message is received, the fourth router 140 sets the dedicated channel path between the third router 130 and the fourth router 140. At the same time, the first router 110, the second router 120, and the third router 130, which receive the path setting MAC message, set a dedicated channel between each corresponding routers and an adjacent router.

The token returning message 530, which returns the third token, may include the number of the third router 130, the number of the fourth router 140, the number of the seventh sensor 131, and the number of the eighth sensor 132. The router 130, which receives the MAC message, cancels the dedicated channel with the seventh sensor 131 and the eighth sensor 132.

Further, the path canceling MAC message 540 of the third token includes the path of the third router dedicated channel 230, and the router 130, which receives the message, cancels the path.

Figure 6:
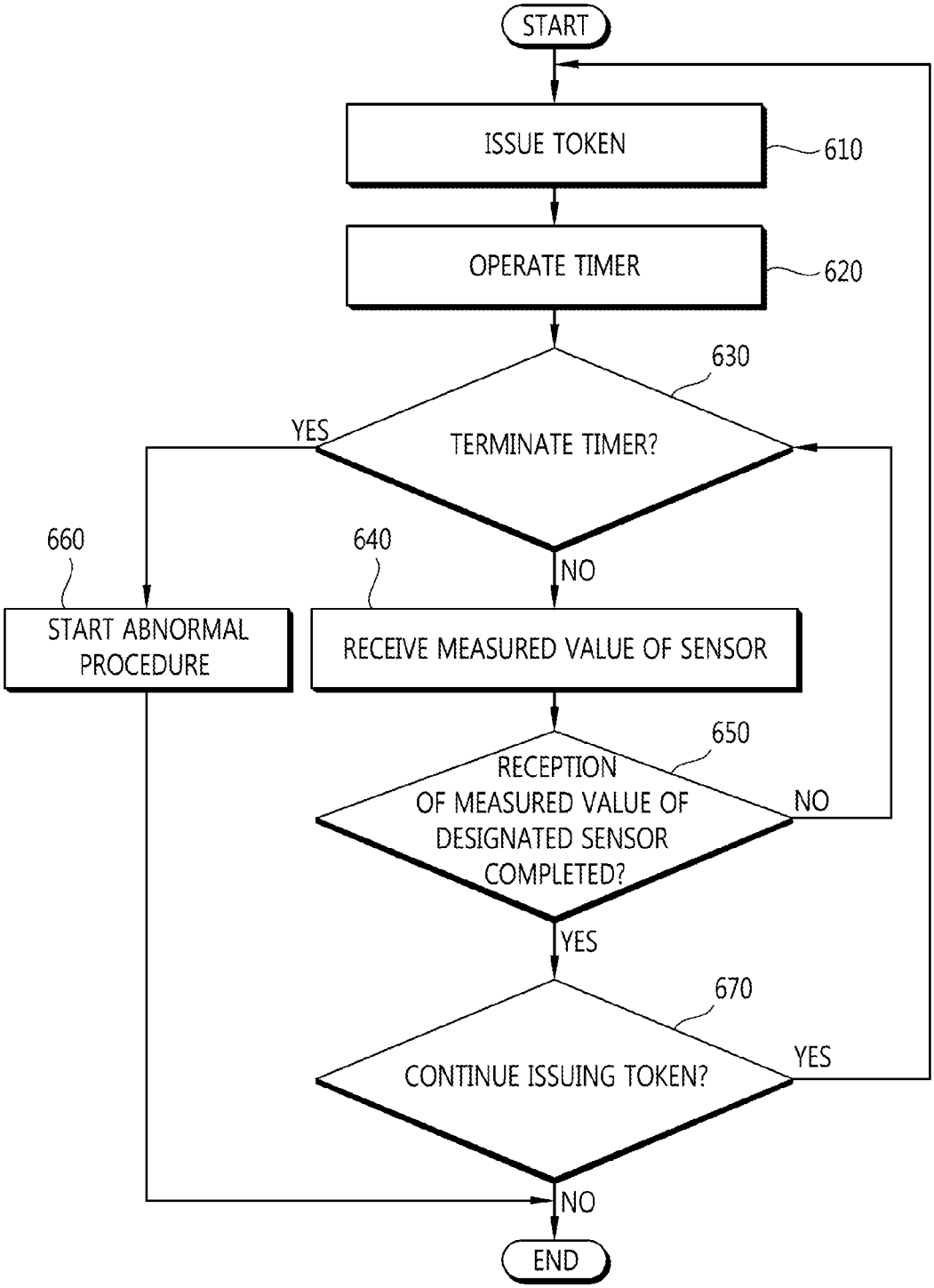
FIG. 6 is a flowchart illustrating operation of a gateway, according to an embodiment of the present invention.

FIG. 6 is a flowchart illustrating operation of a gateway, according to an embodiment of the present invention.

The gateway issues a token by first transmitting a token issuing message to the router in order to receive measured information of sensors, which belong to a specific router, at high speed (610), and operates a timer (620) so as to monitor whether there is a response within a given time (630).

The gateway waits for reception of measured values from sensors in a state where the time is not terminated (640), and repeats the process of receiving the measured values from the entire designated sensors (650). However, when the measured values are not received from all designated sensors even after the time is terminated, an abnormal following procedure is performed (660).

If the measured values are received from al designated sensors, the gateway continually issues the token (670), and may receive the measured values of the sensors, which have been connected all routers, by repeating the process. At this time, when setting the dedicated channel between routers, the gateway may encapsulate the dedicated channel path between routers of the lower hierarchy of the router and transmit the encapsulated path in a tunneling scheme.

Likewise, the gateway may integrate the dedicated channel between routers of the lower hierarchy as well as the dedicated channel with the first router 110 using the token issuing message to control the integrated channels.

Figure 7:
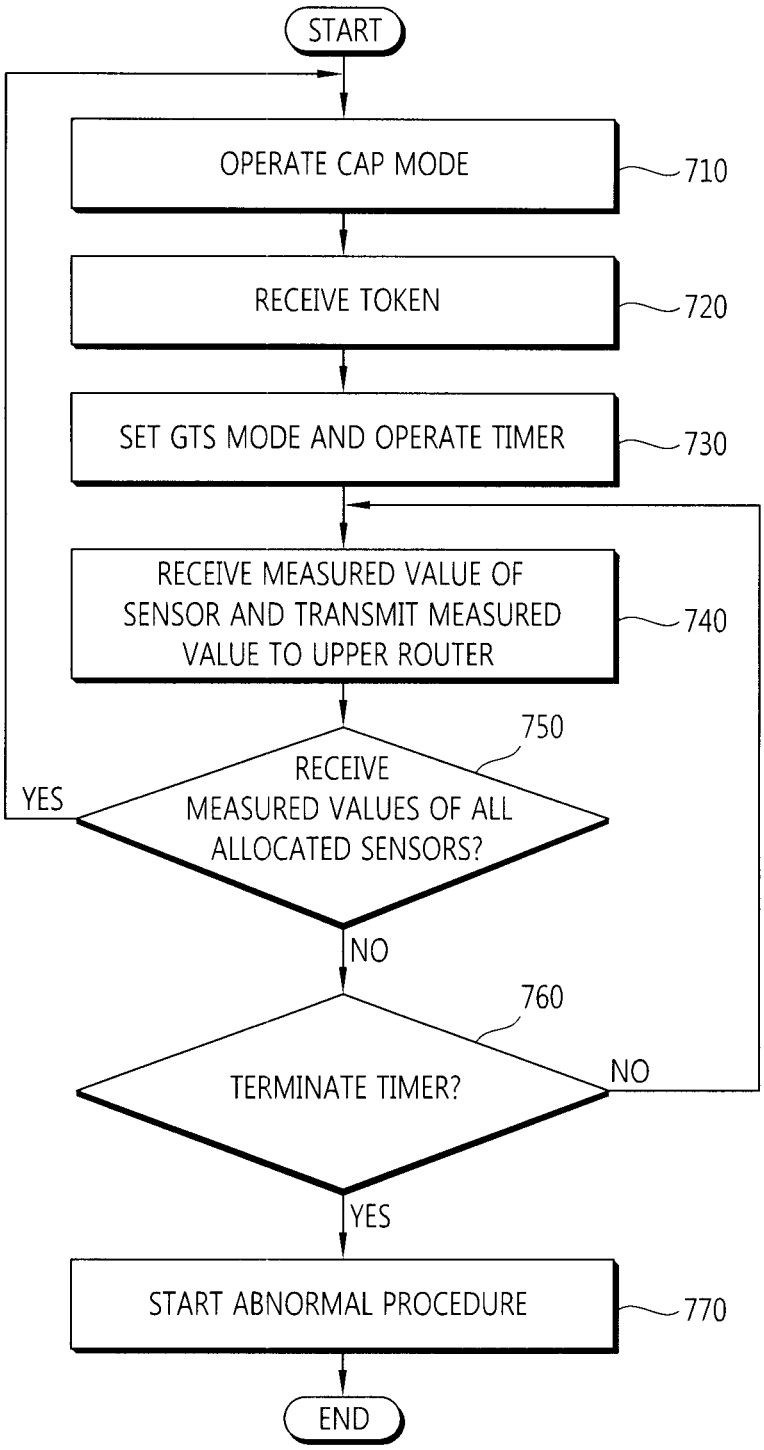
FIG. 7 is a flowchart illustrating operation of a router, according to an embodiment of the present invention.

FIG. 7 is a flowchart illustrating operation of a router, according to an embodiment of the present invention.

The router basically performs communication with sensors at the contention mode (CAP mode) (710). If the token issuing message is received from the gateway (720), the router monitors communication with sensors within a given time by setting the non-contention mode (GTS) and operating a timer (730) according to the information of the token issuing message.

If measured values are received from each sensor, the router transmits the received measured values to the router of the upper hierarchy (740). Such a process may be repeated until timer is terminated or the measured values are received from all sensors (750 and 760). If the timer has been terminated, but the measured values are not received from all sensors, the router may perform an abnormal following procedure (770).

Further, if a token returning message or a token canceling message is received from the gateway, the router may perform a procedure of canceling the dedicated channel with the sensors or the dedicated channel with the upper routers.

According to the present invention, information on the driving state of a railway vehicle may be obtained in real time through a sensor which is mounted on a driving unit of the railway vehicle, and thus the safe driving of the railway vehicle may be secured and the maintenance costs may be minimized.

Further, according to the present invention, the status information of the railway vehicle, which is driven in a poor communication environment, and thus the management of the railway vehicle may be automated.

A person having ordinary skill in the art to which the present invention pertains may change and modify the present invention in various ways without departing from the technical spirit of the present invention. Accordingly, the present invention is not limited to the above-described embodiments and the accompanying drawings.

In the above exemplary system, although the methods have been described based on the flowcharts in the form of a series of steps or blocks, the present invention is not limited to the sequence of the steps, and some of the steps may be performed in a different order from that of other steps or may be performed simultaneous to other steps. Furthermore, those skilled in the art will understand that the steps shown in the flowchart are not exclusive and the steps may include additional steps or that one or more steps in the flowchart may be deleted without affecting the scope of the present invention.

What is claimed is:

1. A railway wireless sensor network apparatus comprising:

sensors mounted on a driving means of a railway vehicle, spatially separated into groups and configured to measure an operation state of the railway vehicle in real time respectively, each of the groups being positioned to transmit information to a specific router;

routers comprised in the railway vehicle and configured to receive information on the measured operation state from one of the sensors through a first dedicated channel between a corresponding router and the one of the sensors; and a gateway included in the railway vehicle and configured to receive information on the operation state through a second dedicated channel between a first router of the routers and the gateway and a third dedicated channel between the first router and a second router of the routers, and configured to transmit information on the received operation state to a railway vehicle control center, wherein the routers form at least one of the first dedicated channel, the second dedicated channel and the third dedicated channel, based on a dedicated channel information in a token from the gateway, wherein the routers are configured to perform communication with the one of the sensors in a contention access mode normally and configured to perform communication with the one of the sensors in a contention-free mode when the token is received from the gateway, wherein the first dedicated channel, the second dedicated channel and the third dedicated channel are formed by communicating in the contention-free mode, and wherein the second router is configured to transmit information on the operation state received from the one of the sensors to the gateway via the first router, which is positioned at a hierarchy higher than a hierarchy of the second router.

2. The railway wireless sensor network apparatus of claim 1, wherein the routers are configured to form the first dedicated channel by utilizing a contention-free period of a medium access control (MAC) frame.

3. The railway wireless sensor network apparatus of claim 1, wherein the token includes a numeric identifier of a corresponding router, a numeric identifier of a corresponding sensor, and information on a use period of a corresponding dedicated channel.

4. The railway wireless sensor network apparatus of claim 1, wherein the gateway is configured to integrate the first dedicated channel, the second dedicated channel and the third dedicated channel, and to control the integrated dedicated channels.

5. The railway wireless sensor network apparatus of claim 1, wherein, the gateway is configured to encapsulate the third dedicated channel in the second dedicated channel in a tunneling scheme.

6. The railway wireless sensor network apparatus of claim 1, wherein, in response to information on the operation state being received from the first router after a timer is terminated, by operating the timer when issuing the token, the gateway transmits a path canceling message to the first router so as to cancel the second dedicated channel with the first router.

7. The railway wireless sensor network apparatus of claim 1, wherein, in response to the token being received from the gateway, the first router operates a timer, and wherein, in response to information on the operation state being received after the timer is terminated, the first router cancels the first dedicated channel, based on a token returning message received from the gateway.

8. The railway wireless sensor network apparatus of claim 1, wherein information on the operation state is information on temperatures and vibrations of bearings which are positioned at axles of the railway vehicle.

9. A method of operating a gateway in a railway wireless sensor network, the method comprising:

transmitting, by the gateway included in a railway vehicle, a first token, comprising a first dedicated channel information, to a first router which is included in the railway vehicle and is configured to perform communication with a first sensor mounted on a driving means of the railway vehicle in a contention access mode normally, wherein the gateway is configured to set the first dedicated channel information to indicate the first router to form a first dedicated channel between the first sensor and the first router and to form a second dedicated channel between the first router and the gateway;

transmitting, by the gateway, a second token, comprising a second dedicated channel information, to a second router, which is included in the railway vehicle and is configured to perform communication with a second sensor mounted on the driving means of the railway vehicle, wherein the gateway is configured to set the second dedicated channel information to indicate the second router to form a third dedicated channel between the first router and the second router and to form a fourth dedicated channel between the second router and the second sensor;

receiving, by the gateway, information on an operation state of the railway vehicle, which is measured in real time by the second sensor, from the second router, through the second dedicated channel formed according to the first dedicated channel information and the third dedicated channel formed according the second dedicated channel information; and transmitting, by the gateway, the received information on the operation state, to a railway vehicle control center, wherein the first dedicated channel, the second dedicated channel, the third dedicated channel and the fourth dedicated channel are formed in a contention-free mode, and wherein the first router is positioned at a hierarchy higher than a hierarchy of the second router.

10. The method of claim 9, wherein the first router is configured to form the first dedicated channel and the second dedicated channel by utilizing a contention-free period of a medium access control (MAC) frame.

11. The method of claim 9, wherein the first token and the second token comprise a numeric identifier of a corresponding router, a numeric identifier of a corresponding sensor, and information on a use period of a corresponding dedicated channel.

12. The method of claim 9, further comprising:

integrating the first dedicated channel, the second dedicated channel, the third dedicated channel and the fourth dedicated channel, and controlling the integrated dedicated channels.

13. The method of claim 9, further comprising:

encapsulating the third dedicated channel in the second dedicated channel in a tunneling scheme.

14. The method of claim 9, after transmitting the first token issuing message, further comprising:

operating a timer; and canceling the second dedicated channel by transmitting a path canceling message to the first router in response to information on the operation state being received from the first router after the timer is terminated.

15. A method of operating a router in a railway wireless sensor network, the method comprising:

receiving, by the router which is included in a railway vehicle and is configured to perform communication with a sensor mounted on a driving means in the railway vehicle in a contention access mode normally, a token from a gateway comprised in the railway vehicle;

forming, by the router, a first dedicated channel between the sensor and the router and a second dedicated channel between the router and another router according to a dedicated channel information included in the token;

receiving, by the router, information on an operation state of the railway vehicle, from the sensor, through the first dedicated channel in a contention-free mode; and transmitting, by the router, information on the received operation state to the gateway through the second dedicated channel in the contention-free mode, wherein the first dedicated channel and the second dedicated channel are formed in the contention-free mode, and wherein the another router is positioned at a hierarchy higher than a hierarchy of the router.

16. The railway wireless sensor network apparatus of claim 1, wherein the sensors, the routers and the gateway configures a low-power railway wireless sensor network.

17. The railway wireless sensor network apparatus of claim 1, wherein the second router is an adjacent router to the first router.

* * * * *